US011889862B2

(12) United States Patent
Kim et al.

(10) Patent No.: US 11,889,862 B2
(45) Date of Patent: Feb. 6, 2024

(54) APPARATUS AND SYSTEM FOR GENERATING AEROSOLS

(71) Applicant: KT&G CORPORATION, Daejeon (KR)

(72) Inventors: Tae Hun Kim, Yongin-si (KR); Jae Sung Choi, Hanam-si (KR)

(73) Assignee: KT&G CORPORATION, Daejeon (KR)

( * ) Notice: Subject to any disclaimer, the term of this patent is extended or adjusted under 35 U.S.C. 154(b) by 856 days.

(21) Appl. No.: 16/961,868

(22) PCT Filed: Oct. 10, 2019

(86) PCT No.: PCT/KR2019/014055
§ 371 (c)(1),
(2) Date: Jul. 13, 2020

(87) PCT Pub. No.: WO2020/101213
PCT Pub. Date: May 22, 2020

(65) Prior Publication Data

US 2020/0345066 A1 Nov. 5, 2020

(30) Foreign Application Priority Data

Nov. 16, 2018 (KR) ..... 10-2018-0141970

(51) Int. Cl.
*A24F 40/30* (2020.01)
*A24F 40/485* (2020.01)
(Continued)

(52) U.S. Cl.
CPC ..... *A24F 40/30* (2020.01); *A24F 40/10* (2020.01); *A24F 40/20* (2020.01); *A24F 40/42* (2020.01); *A24F 40/485* (2020.01)

(58) Field of Classification Search
None
See application file for complete search history.

(56) References Cited

U.S. PATENT DOCUMENTS 9,220,304 B2 12/2015 Greim
10,375,994 B2 8/2019 Mironov et al.
(Continued)

FOREIGN PATENT DOCUMENTS

CN 105939625 A 9/2016
CN 106455713 A 2/2017
(Continued)

OTHER PUBLICATIONS

International Search Report for PCT/KR2019/014055 dated, Feb. 5, 2020 (PCT/ISA/210).
(Continued)

*Primary Examiner* — Kelly M Gambetta
*Assistant Examiner* — Katherine A Will
(74) *Attorney, Agent, or Firm* — Sughrue Mion, PLLC

(57) ABSTRACT

An aerosol generating apparatus includes a main body; a cartridge detachably coupled to the main body, comprising an air inlet hole through which external air is introduced, and configured to store a liquid material and generate aerosol by heating the liquid material; a cigarette detachably coupled to the main body, comprising a solid material, and disposed on a path along which the aerosol generated in the cartridge flows such that the aerosol passes through the solid material and is discharged to outside; and a cover detachably coupled to the main body to cover the cartridge coupled to the main body and comprising: a cigarette hole through which the cigarette is coupled to the main body; and a ventilation hole formed at a position adjacent to the air inlet hole of the cartridge and configured to discharge the aerosol remaining in the cartridge to the outside or introduce the external air.

7 Claims, 9 Drawing Sheets

(51) Int. Cl.

| | |
|---|---|
| ***A24F 40/10*** | (2020.01) |
| ***A24F 40/20*** | (2020.01) |
| ***A24F 40/42*** | (2020.01) |

(56) References Cited

U.S. PATENT DOCUMENTS

| | | | | |
|---|---|---|---|---|
| 10,543,323 | B2 | 1/2020 | Buchberger | |
| 11,178,910 | B2 | 11/2021 | Kim et al. | |
| 11,246,341 | B2 | 2/2022 | Han et al. | |
| 11,287,838 | B2 | 3/2022 | Malgat et al. | |
| 2013/0014772 | A1* | 1/2013 | Liu | A24F 40/30 131/329 |
| 2013/0081642 | A1 | 4/2013 | Safari | |
| 2013/0319404 | A1 | 12/2013 | Feriani et al. | |
| 2017/0354184 | A1 | 12/2017 | Mironov et al. | |
| 2018/0042299 | A1 | 2/2018 | Han et al. | |
| 2018/0271153 | A1 | 9/2018 | John et al. | |
| 2020/0329772 | A1 | 10/2020 | Kim et al. | |
| 2021/0145051 | A1* | 5/2021 | Florack | A24F 40/485 |

FOREIGN PATENT DOCUMENTS

| | | | |
|---|---|---|---|
| JP | 2012-506263 | A | 3/2012 |
| JP | 2013-542798 | A | 11/2013 |
| JP | 2015-13192 | A | 1/2015 |
| KR | 20-0461404 | Y1 | 7/2012 |
| KR | 10-2015-0143156 | A | 12/2015 |
| KR | 10-1667502 | B1 | 10/2016 |
| KR | 10-2017-0118233 | A | 10/2017 |
| KR | 10-2018-0070457 | A | 6/2018 |
| KR | 10-2018-0070517 | A | 6/2018 |
| KR | 10-2018-0111460 | A | 10/2018 |
| WO | 2018/112766 | A1 | 6/2018 |
| WO | 2018/208078 | A2 | 11/2018 |
| WO | 2019/088586 | A2 | 5/2019 |

OTHER PUBLICATIONS

Chinese Office Action dated Oct. 9, 2022 in Chinese Application No. 201980006380.0.

Notification of Reason for Refusal dated Jun. 9, 2020 from the Koran Intellectual Property Office in KR Application No. 10-2018-0141970.

Extended European Search Report dated Mar. 3, 2022 in European Application No. 19884932.5.

* cited by examiner

APPARATUS AND SYSTEM FOR GENERATING AEROSOLS

CROSS REFERENCE TO RELATED APPLICATIONS

This application is a National Stage of International Application No. PCT/KR2019/014055 filed Oct. 24, 2019, claiming priority based on Korean Patent Application No. 10-2018-0141970, filed Nov. 16, 2018.

TECHNICAL FIELD

Embodiments relate to an aerosol generating apparatus and an aerosol generating system, and more particularly, to an aerosol generating apparatus and an aerosol generating system capable of generating aerosol having a rich flavor by passing aerosol generated in a cartridge through a cigarette.

BACKGROUND ART

Recently, the demand for non-combustion type aerosol generating articles and aerosol generating apparatus that replace traditional cigarettes has increased. A non-combustion type aerosol generating apparatus is an apparatus that generates aerosol from an aerosol-generating material contained in a cigarette by heating the cigarette to a predetermined temperature without combusting the cigarette or by heating a liquid material so that the generated aerosol may be inhaled together with air.

In the apparatus disclosed in US Patent Publication US 2018-0042299 A1, an atomizer containing a liquid material transmits aerosol generated by heating a liquid to a user, and the aerosol generation is basically performed by the atomizer. In this apparatus, when the atomizer generates the aerosol, and the heater included in the atomizer heats a cigarette aligned with the axis of the atomizer extending in the longitudinal direction of the atomizer. Then, the apparatus performs a function to mix the aerosol generated by the atomizer and cigarette smoke generated from the cigarette, and delivers the aerosol to the user. However, the cigarette is not fully used here in that the aerosol generated in the atomizer is transmitted to the user without passing through the cigarette. Moreover, after air introduced into the apparatus is mixed with the aerosol generated by the atomizer and delivered to the user, part of the aerosol may remain in the aerosol-generating chamber of the apparatus and be trapped in there. The remaining aerosol may be liquefied by the decreased temperature and may soak the cigarette. Also, the liquefied aerosol may flow to other components inside the apparatus and cause the apparatus to malfunction.

The apparatus disclosed in Japanese Patent Publication JP 2012-506263 A supplies aerosol generated in a liquid container to a user through a porous filling material. In this apparatus, the liquid container is designed to only perform the function of containing the liquid, and a component such as a heater for heating the liquid is installed in an inhaler component, which is an element independent of the liquid container. This structure is intended to prevent contamination by preventing liquid in the liquid container from entering the inhaler component. In other words, an inhaler element including the liquid container and the inhaler component including an electronic component are designed to be separable, so that the liquid generated by condensation of the aerosol does not flow from the liquid container to the electronic components. However, even with this configuration, in order for the user to inhale the aerosol smoothly, it is necessary to form an air passage connecting the chamber where vaporization takes place and the electronic components. Therefore, unless the user manually separates the inhaler element and the inhaler component after inhalation of the aerosol, it is difficult to prevent liquid droplets generated in the liquid container and the chamber from flowing into the electronic components through the air passage. Also, this apparatus does not have any means to treat the aerosol remaining inside the chamber after the user's aerosol inhalation. In addition, in this apparatus, since the liquid container, the porous filling material, and a mouthpiece are all combined to form one replaceable inhaler element, it is difficult to replace the porous filling material alone, and the entire inhaler element needs be replaced after the inhaler element is used, which increases user's expenses.

Korean Patent Publication KR 10-2018-0070517 A is a patent application filed by the present applicant and discloses a method of heating a cigarette only. In such an aerosol generating apparatus, since aerosol is generated using only cigarettes, there is no technical problem related to liquid drops (droplets) of liquid generated by condensation of the vaporized aerosol.

DESCRIPTION OF EMBODIMENTS

Technical Problem

Embodiments provide an aerosol generating apparatus and an aerosol generating system that may provide a user with a variety of experiences and ease of use by using a combination of a cartridge that generates aerosol by heating a liquid material and a cigarette containing a solid material.

An aerosol generating apparatus and system according to embodiments provide a user with aerosol containing a suitable flavor, nicotine, etc. by passing aerosol flow through a cigarette containing a solid material after generating aerosol by heating a liquid material.

Solution to Problem

The aerosol generating system according to an embodiment includes a main body; a cartridge detachably coupled to the main body, comprising an air inlet hole through which external air is introduced, and configured to store a liquid material and generate aerosol by heating the liquid material; a cigarette detachably coupled to the main body, comprising a solid material, and disposed on a path along which the aerosol generated in the cartridge flows such that the aerosol passes through the solid material and is discharged to outside; and a cover detachably coupled to the main body to cover the cartridge coupled to the main body and comprising: a cigarette hole through which the cigarette is coupled to the main body; and a ventilation hole formed at a position adjacent to the air inlet hole of the cartridge and configured to discharge the aerosol remaining in the cartridge to the outside or introduce the external air.

The cigarette may have a rod shape extending along one direction and the aerosol may pass along the longitudinal direction in the cigarette and be discharged to the outside.

The cartridge and the cigarette may be arranged in parallel with respect to the one direction.

The main body may include a cigarette support portion comprising a cigarette insertion passage into which at least a portion of the cigarette is inserted, supporting the cigarette inserted in the cigarette insertion passage, and configured to transfer heat to the cigarette; and a cartridge mounting portion formed next to the cigarette support portion and detachably supporting the cartridge.

The air inlet hole of the cartridge may be located opposite the cigarette insertion passage on a face of the cartridge, the face facing the cover when the cartridge is coupled to the cartridge mounting portion.

The cover may further include an upper plate which includes the cigarette hole and faces a face of the cartridge coupled to the main body and an upper surface of the cigarette support portion, and a side plate which extends from the upper plate toward the main body to cover the side of the cigarette support portion and the side of the cartridge.

The ventilation hole may be formed at a position adjacent to the air inlet hole of the cartridge in the side plate.

The cartridge may further include a liquid heater for heating the liquid material, a chamber surrounding the liquid heater to define a space in which the aerosol is generated, an outlet connecting the chamber toward the cigarette to discharge the aerosol toward the cigarette, and an air passage connecting the chamber and the air inlet hole to each other.

The air passage may extend in the direction in which the cigarette extends, and the cigarette and the air passage are arranged in parallel with respect to the direction in which the cigarette extends.

The cigarette hole of the cover may be formed such that at least a portion of an inner surface of the cigarette hole facing the cigarette is separated from the cigarette to introduce the external air to inside of the cover.

The aerosol generating apparatus according to another embodiment includes a main body; a cartridge mounting portion installed in one area of the main body to detachably support a cartridge, wherein the cartridge stores a liquid material, generates aerosol by heating the liquid material, and includes an air inlet hole through which external air is introduced; a cigarette support portion installed in another area of the main body to detachably support a cigarette including a solid material, and configured to transfer the aerosol generated in the cartridge to the cigarette and heat the cigarette; an electricity supply portion disposed on the main body and configured to supply electricity to the cartridge and the cigarette support portion coupled to the main body; and a cover detachably coupled to the main body to cover the cartridge coupled to the main body, comprising a cigarette hole through which the cigarette is coupled to the main body and a ventilation hole formed at a position adjacent to the air inlet hole of the cartridge, and configured to discharge the aerosol remaining in the cartridge to outside or introduce the external air.

Advantageous Effects of Disclosure

According to the aerosol generating apparatus and system according to the above-described embodiments, after heating a liquid material to produce aerosol, the flow of the generated aerosol can be passed through a cigarette to provide a user with aerosol including an appropriate flavor and nicotine.

In addition, since the aerosol generated by the cartridge after the user's inhalation action is easily discharged to the outside through the ventilation hole of the cover, the phenomenon that droplets (liquid drops) are formed inside the aerosol generating apparatus can be minimized. Therefore it is possible to prevent electronic components from being contaminated by the droplets.

BEST MODE

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. Also, specified terms may be selected by the applicant, and in this case, the detailed meaning thereof will be described in the detailed description of the disclosure. Thus, the terms used in the present disclosure should be understood not as simple names but based on the meaning of the terms and the overall description of the present disclosure.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

Figure 1:
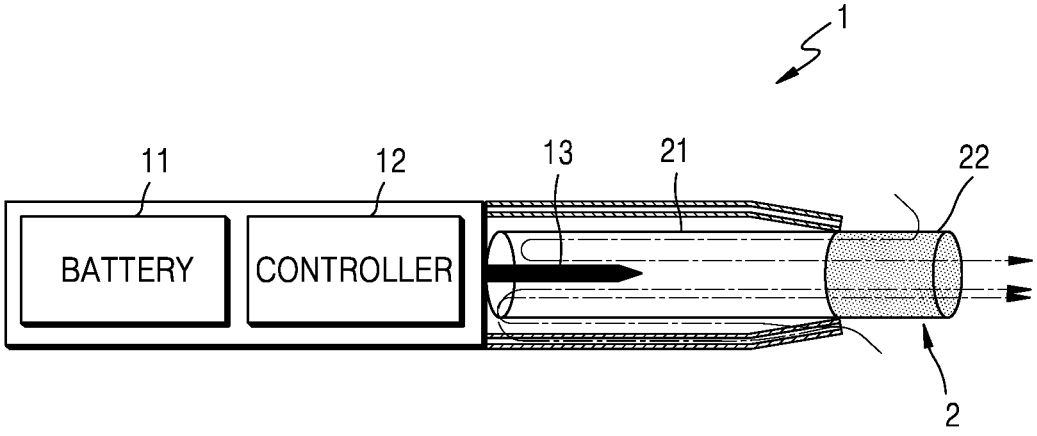
FIGS. 1 through 3 are diagrams showing examples in which a cigarette is inserted into an aerosol generating apparatus.
Figure 2:
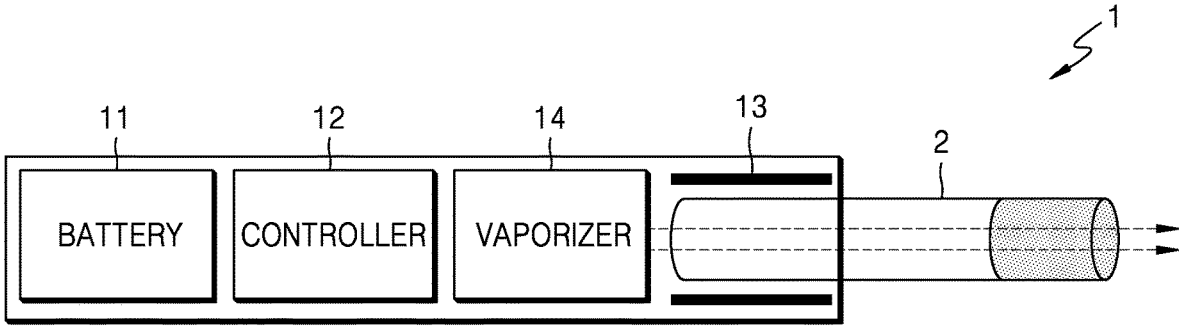
Figure 3:
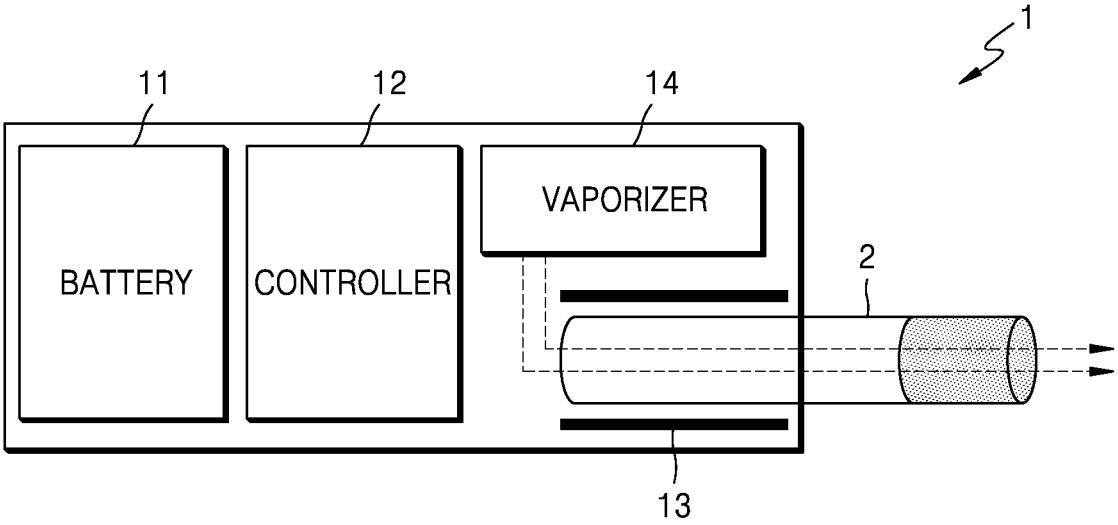

FIGS. 1 through 3 are diagrams showing examples in which a cigarette is inserted into an aerosol generating apparatus.

Referring to FIG. 1, an aerosol generating apparatus 1 includes a battery 11, a controller 12, and a heater 13. Referring to FIGS. 2 and 3, the aerosol generating apparatus 1 further includes a vaporizer 14. Also, a cigarette 2 may be inserted into an inside space of the aerosol generating apparatus 1.

FIG. 1 through show the aerosol generating apparatus 1 with some elements related to the embodiment. Therefore, it will be understood by one of ordinary skill in the art that the aerosol generating apparatus 1 may further include additional general purpose elements in addition to elements shown in FIGS. 1 through 3.

Furthermore, although FIGS. 1 through 3 illustrate that the aerosol generating apparatus 1 includes the heater 13, as necessary, the heater 13 may be omitted.

FIG. 1 illustrates that the battery 11, the controller 12, and the heater 13 are linearly arranged. Also, FIG. 2 illustrates that the battery 11, the controller 12, the vaporizer 14, and the heater 13 are linearly arranged. Furthermore, FIG. 3 illustrates that the vaporizer 14 and the heater 13 are arranged in parallel. However, the internal structure of the aerosol generating apparatus 1 is not limited to the illustration of FIGS. 1 through 2. In other words, according to the design of the aerosol generating apparatus 1, the arrangement of the battery 11, the controller 12, the heater 13, and the vaporizer 14 may be changed.

When the cigarette 20 is inserted into the aerosol generating apparatus 1, the aerosol generating apparatus 1 generates aerosol by operating the heater 13 and/or the vaporizer 14. The aerosol generated by the heater 13 and/or the vaporizer 14 is transferred to a user by passing through the cigarette 20.

In some cases, the aerosol generating apparatus 1 may operate the heater 13 even when the cigarette 2 is not inserted into the aerosol generating apparatus 1.

The battery 11 supplies power used to operate the aerosol generating apparatus 1. For example, the battery 11 may supply power to heat the heater 13 or the vaporizer 14, or may supply power needed to operate the controller 12. Furthermore, the battery 11 may supply power needed to operate a display, a sensor, or a motor installed in the aerosol generating apparatus 1.

The controller 12 controls overall operations of the aerosol generating apparatus 1. In detail, the controller 12 controls not only the battery 11, the heater 13, and the vaporizer 14, but also operations of other elements included in the aerosol generating apparatus 1. Furthermore, the controller 12 may determine whether the aerosol generating apparatus 1 is in an operable state by checking the state of each of the constituent elements of the aerosol generating apparatus 1.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the cigarette 2 is inserted into the aerosol generating device 1, the heater 13 may be located outside the cigarette 2. Thus, the heated heater 13 may increase a temperature of an aerosol generating material in the cigarette 2.

The heater 13 may include an electro-resistive heater. For example, the heater 13 may include an electrically conductive track, and the heater 13 may be heated when currents flow through the electrically conductive track. However, the heater 13 is not limited to the example described above and any other heaters capable of being heated to a desired temperature may be used. Here, the desired temperature may be pre-set in the aerosol generating device 1 or may be manually set by a user.

As another example, the heater 13 may include an induction heater. In detail, the heater 13 may include an electrically conductive coil for heating a cigarette in an induction heating method, and the cigarette may include a susceptor which may be heated by the induction heater.

For example, the heater 13 may include a tube-type heating element, a plate-type heating element, a needle-type heating element, or a rod-type heating element, and may heat the inside or the outside of the cigarette 2, according to the shape of the heating element.

Also, the aerosol generating device 1 may include a plurality of heaters 13. Here, the plurality of heaters 13 may be inserted into the cigarette 2 or may be arranged outside the cigarette 2. Also, some of the plurality of heaters 13 may be inserted into the cigarette 2 and the others may be arranged outside the cigarette 2. In addition, the shape of the heater 13 is not limited to the shapes illustrated in FIGS. 1 through 3 and may include various shapes.

The vaporizer 14 may generate aerosol by heating a liquid composition and the generated aerosol may pass through the cigarette 2 to be delivered to a user. In other words, the aerosol generated via the vaporizer 14 may move along an air flow passage of the aerosol generating device 1 and the air flow passage may be configured such that the aerosol generated via the vaporizer 14 passes through the cigarette 2 to be delivered to the user.

For example, the vaporizer 14 may include a liquid storage, a liquid delivery element, and a heating element, but it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be attached/detached to/from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but it is not limited thereto.

The aerosol generating device 1 may further include general-purpose components in addition to the battery 11, the controller 12, the heater 13, and the vaporizer 14. For example, the aerosol generating device 1 may include a display capable of outputting visual information and/or a motor for outputting haptic information. Also, the aerosol generating device 1 may include at least one sensor (a puff detecting sensor, a temperature detecting sensor, a cigarette insertion detecting sensor, etc.). Also, the aerosol generating device 1 may be formed as a structure where, even when the cigarette 2 is inserted into the aerosol generating device 1, external air may be introduced or internal air may be discharged.

Although not illustrated in FIGS. 1 through 3, the aerosol generating device 1 and an additional cradle may form together a system. For example, the cradle may be used to charge the battery 11 of the aerosol generating device 1. Alternatively, the heater 13 may be heated when the cradle and the aerosol generating device 1 are coupled to each other.

The cigarette 2 may be similar as a general combustive cigarette. For example, the cigarette 2 may be divided into a first portion including an aerosol generating material and a second portion including a filter, etc. Alternatively, the second portion of the cigarette 2 may also include an aerosol generating material. For example, an aerosol generating material made in the form of granules or capsules may be inserted into the second portion.

The entire first portion may be inserted into the aerosol generating device 1, and the second portion may be exposed to the outside. Alternatively, only a portion of the first portion may be inserted into the aerosol generating device 1. Otherwise, the entire first portion and a portion of the second portion may be inserted into the aerosol generating device 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1. For example, opening and closing of the air passage and/or a size of the air passage may be adjusted by the user. Accordingly, the amount and quality of vapor may be adjusted by the user. As another example, the external air may flow into the cigarette 2 through at least one hole formed in a surface of the cigarette 2.

MODE OF DISCLOSURE

Hereinafter, examples of the cigarette 2 will be described with reference to FIGS. 4 and 5.

Figure 4:
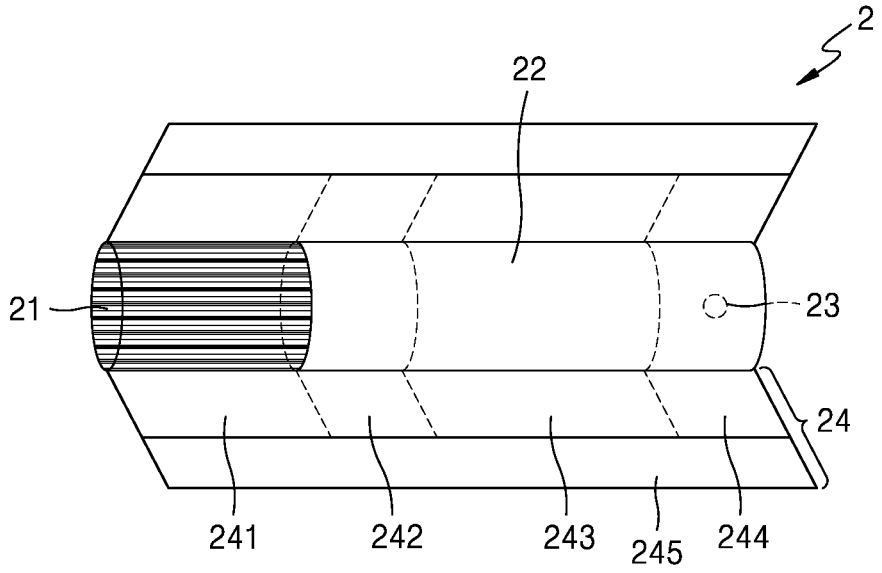
FIGS. 4 and 5 are diagrams showing examples of a cigarette.
Figure 5:
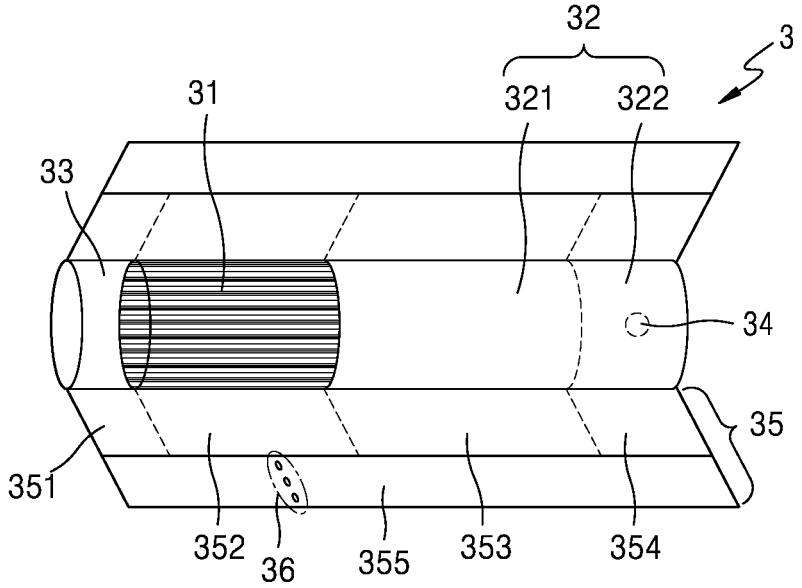

FIGS. 4 and 5 illustrate examples of a cigarette.

Referring to FIG. 4, the cigarette 2 may include a tobacco rod 21 and a filter rod 22. The first portion 21 described above with reference to FIGS. 1 through 3 may include the tobacco rod 21, and the second portion may include the filter rod 22.

FIG. 4 illustrates that the filter rod 22 includes a single segment. However, the filter rod 22 is not limited thereto. In other words, the filter rod 22 may include a plurality of segments. For example, the filter rod 22 may include a first segment that cools aerosol and a second segment that filters a certain component included in the aerosol. Also, as necessary, the filter rod 22 may further include at least one segment that performs other functions.

The cigarette 2 may be packaged by at least one wrapper 24. The wrapper 24 may have at least one hole through which external air may be introduced or internal air may be discharged. For example, the cigarette 2 may be packaged by one wrapper 24. As another example, the cigarette 2 may be doubly packaged by at least two wrappers 24. For example, the tobacco rod 21 may be packaged by a first wrapper 241, and the filter rod 22 may be packaged by a second wrapper 242, 243, and 244. Also, the entire cigarette 2 may be packaged by a single wrapper 245. When the filter rod 22 includes a plurality of segments, each segment may be packaged by each of wrappers 242, 243, 244.

The tobacco rod 21 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21 may include other additives, such as flavors, a wetting agent, and/or organic acid. Also, the tobacco rod 21 may include a flavored liquid, such as menthol or a moisturizer, which is injected to the tobacco rod 21.

The tobacco rod 21 may be manufactured in various forms. For example, the tobacco rod 21 may be formed as a sheet or a strand. Also, the tobacco rod 21 may be formed as a pipe tobacco, which is formed of tiny bits cut from a tobacco sheet. Also, the tobacco rod 21 may be surrounded by a heat conductive material. For example, the heat-conducting material may be, but is not limited to, a metal foil such as aluminum foil. For example, the heat conductive material surrounding the tobacco rod 21 may uniformly distribute heat transmitted to the tobacco rod 21, and thus, the heat conductivity applied to the tobacco rod may be increased and taste of the tobacco may be improved. Also, the heat conductive material surrounding the tobacco rod 21 may function as a susceptor heated by the induction heater. Here, although not illustrated in the drawings, the tobacco rod 21 may further include an additional susceptor, in addition to the heat conductive material surrounding the tobacco rod 21.

The filter rod 22 may include a cellulose acetate filter. Shapes of the filter rod 22 are not limited. For example, the filter rod 22 may include a cylinder-type rod or a tube-type rod having a hollow inside. Also, the filter rod 22 may include a recess-type rod. When the filter rod 22 includes a plurality of segments, at least one of the plurality of segments may have a different shape.

Also, the filter rod 22 may include at least one capsule 23. Here, the capsule 23 may generate a flavor or aerosol. For example, the capsule 23 may have a configuration in which a liquid containing a flavoring material is wrapped with a film. For example, the capsule 23 may have a spherical or cylindrical shape, but is not limited thereto.

Referring to FIG. 5, the cigarette 2 may further include a front-end filter 33. The front-end filter 33 may be located on a side of the tobacco rod 21, the side not facing the filter rod 22. The front-end filter 33 may prevent the tobacco rod 31 from falling off and prevent the liquefied aerosol from flowing into the aerosol generating device 1 (FIGS. 1 through 3) from the tobacco rod 21, during smoking.

The filter rod 32 may include a first segment 321 and a second segment 322. Here, the first segment 321 may correspond to the first segment of the filter rod 22 of FIG. 4, and the second segment 322 may correspond to the third segment of the filter rod 22 of FIG. 4.

The total length and diameter of the cigarette 3 may correspond to the total length and diameter of the cigarette 2 of FIG. 4. For example, the length of the front-end filter 33 may be about 7 mm, the length of the tobacco rod 31 may be about 15 mm, the length of the first segment 321 may be about 12 mm, and the length of the first segment 322 may be about 14 mm, but the embodiments are not limited thereto.

The cigarette 3 may be packaged by at least one wrapper 35. The wrapper 35 may have at least one hole through which external air may be introduced or internal air may be discharged. For example, the front-end filter 33 may be packaged by a first wrapper 351, the filter rod 31 may be packaged by a second wrapper 352, the first segment 321 may be packaged by a third wrapper 353, and the second segment 322 may be packaged by a fourth wrapper 354. Additionally, a whole part of the cigarette 3 may be packaged by a fifth wrapper 355.

Also, the fifth wrapper 355 may have at least one perforation 36. For example, the perforation 36 may be formed at a portion of the fifth wrapper 355 surrounding the tobacco rod 31. The perforation 36 may perform a function of transmitting heat generated by the heater 31 shown in FIGS. 2 and 3 to the inside of the tobacco rod 31.

Also, the second segment 322 may include at least one capsule 34. Here, the capsule 34 may generate a flavor or aerosol. For example, the capsule 34 may have a configuration in which a liquid containing a flavoring material is wrapped with a film. For example, the capsule 34 may have a spherical or cylindrical shape, but is not limited thereto.

Figure 6:
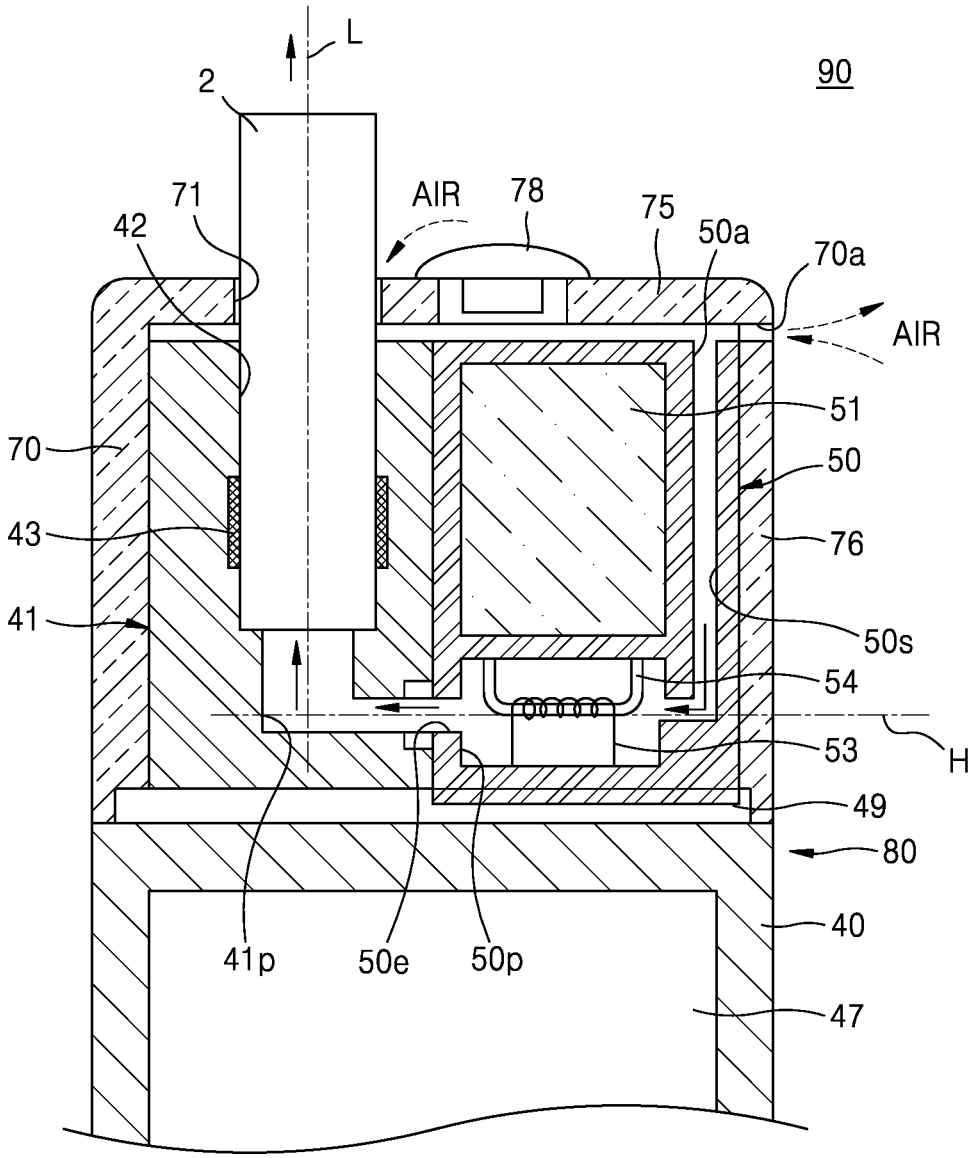
FIG. 6 is a cross-sectional view schematically showing a portion of an aerosol generating system according to another embodiment.
Figure 7:
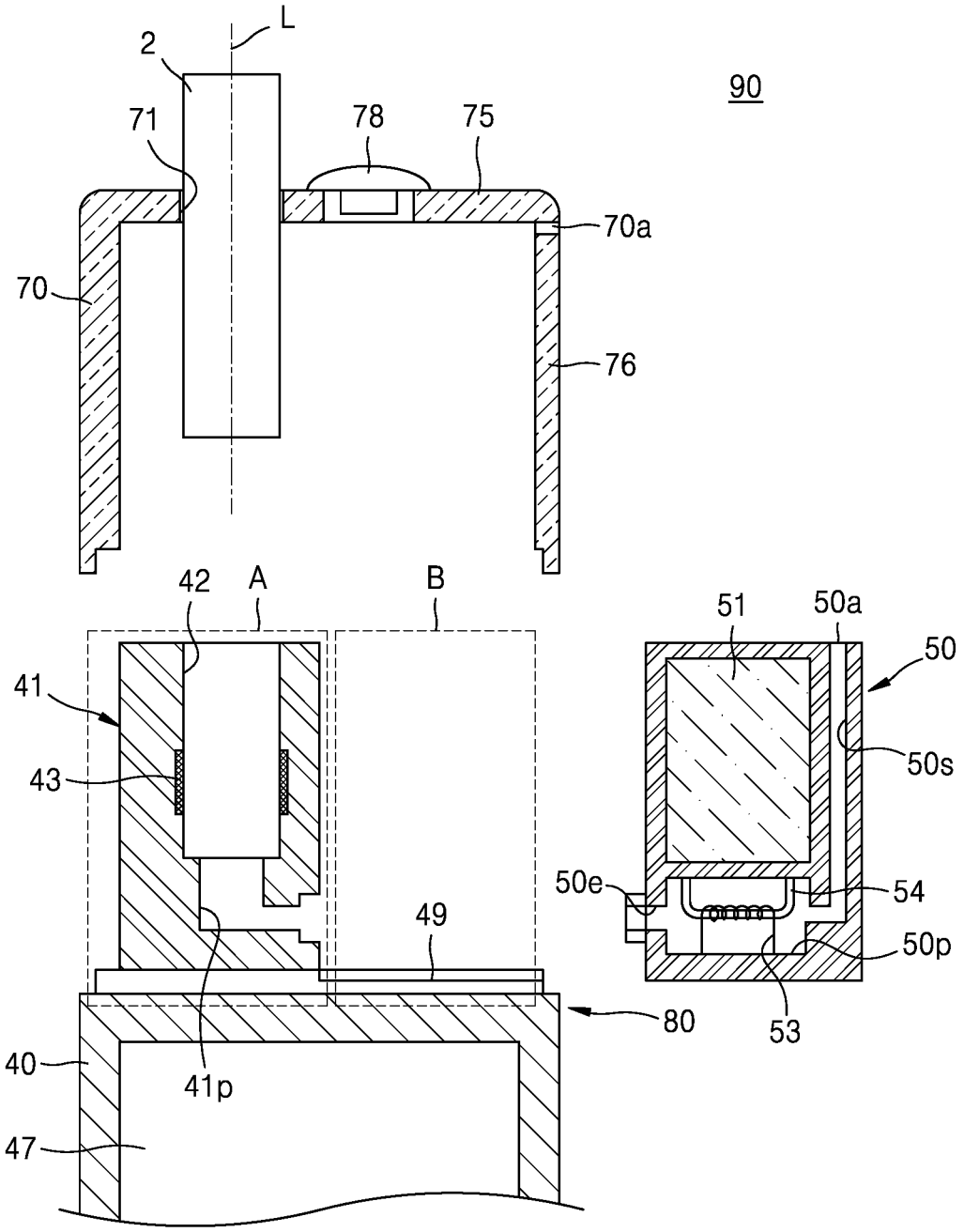
FIG. 7 is an exploded view schematically showing a coupling relationship between components of the aerosol generating system according to the embodiment shown in FIG. 6.

FIG. 6 is a cross-sectional view schematically showing a portion of an aerosol generating system according to another embodiment, and FIG. 7 is an exploded view schematically showing a coupling relationship between components of the aerosol generating system according to the embodiment shown in FIG. 6.

The aerosol generating system 90 according to the embodiment shown in FIGS. 6 and 7 includes an aerosol generating apparatus 80, a cartridge 50 detachably coupled to a main body 40, and a cigarette 2 detachably coupled to the main body 40, wherein the aerosol generating apparatus 80 includes the main body 40, a cartridge mounting portion 49, a cigarette support portion 41 for detachably supporting the cigarette 2, and a cover 70.

The main body 40 may include the cartridge mounting portion 49 that detachably supports the cartridge 50 in one area A, and include the cigarette support portion 41 for detachably supporting the cigarette 2 in another region B The cartridge mounting portion 49 is arranged next to the cigarette support portion 41 to detachably support the cartridge 50. The cartridge mounting portion 49 may be arranged next to the cigarette support portion 41. Therefore, when the cigarette 2 and the cartridge 50 are mounted on the main body 40, the cartridge 50 and the cigarette 2 may be disposed in parallel with respect to the direction in which the cigarette 2 extends.

The cartridge mounting portion 49 may guide the coupling operation of the cartridge 50, and may include coupling means to maintain the coupling state, such as, for example, rails, mounting grooves or projections, and magnets.

The main body 40 may include an electricity supply unit 47 for supplying electricity to the cartridge 50 and the cigarette support portion 41. The electricity supply portion 47 may include a battery and a controller. The region A and the other region B of the main body 40 are provided on an upper portion of the main body 40, and the cartridge mounting portion 49 and the cigarette support portion 41 are installed on the upper portion of the main body 40.

The cartridge 50 storing a liquid material 51 may be detachably coupled to the main body 40. The cartridge 50 includes an air inlet hole 50*a* through which air is introduced from outside, and heats the liquid material 51 to generate aerosol.

The cigarette 2 including a solid material may be located on a path through which the aerosol generated in the cartridge 50 flows. As such, the aerosol passes through the solid material and is discharged to the outside. Thereby, the aerosol is supplied to the user. The cigarette 2 is detachably coupled to the cigarette support portion 41 of the main body 40. The cigarette 2 has a rod shape extending long along the direction indicated by the dotted line L in FIGS. 6 and 7. The aerosol may be discharged to the outside after passing the aerosol along the longitudinal direction.

The cigarette support portion 41 includes a cigarette insertion passage 42 into which a portion of the cigarette 2 is inserted, and may detachably support the cigarette 2. A cigarette heater 43 is disposed in the cigarette insertion passage 42 of the cigarette support portion 41. The cigarette heater 43 is in direct contact with or adjacent to the outer surface of the cigarette 2 inserted into the cigarette support portion 41, and thus the cigarette 2 may be heated by the heat generated in the cigarette heater 43 when the electricity is supplied to the cigarette heater 43 from the electricity supply portion 47. Since the cigarette 2 heated by the cigarette heater 43 may generate flavor, the flavor may be added to the aerosol when the aerosol generated in the cartridge 50 passes through the cigarette 2.

The cartridge 50 is a replaceable component that accommodates a liquid material 51 (liquid composition) that is an aerosol generating source used in the aerosol generating apparatus. The cartridge 50 accommodates the liquid material 51 therein, and when electricity is applied to the cartridge 50, the cartridge 50 heats the liquid material 51 to vaporize, thereby generating aerosol.

The cartridge 50 includes a liquid heater 51 for heating the liquid material 51, a chamber 50*p* that defines a space in which the aerosol is generated by surrounding the liquid heater 53, an outlet 50*e* connecting the chamber 50*p* to the cigarette 2 side such that the aerosol is discharged to the cigarette 2 side, and an air passage 50*s* connecting the air inlet hole 50*a* and the chamber 50*p* to each other. The liquid heater 53 may be implemented with an electric resistance coil and may surround or be positioned near the wick 54 that absorbs and contains the liquid material 51. The liquid heater 53 may be supplied with electricity from the electricity supply portion 47 by being electrically connected to an electricity connection terminal disposed in the cartridge mounting portion 49.

The liquid material 51 stored in the cartridge 50 may include a flavor material that generates scent. The liquid material 51 may exist in a liquid state at room temperature, and may include a material that is vaporized to aerosol when heated.

The air inlet hole 50*a* of the cartridge 50 performs a function of introducing air from the outside of the aerosol generating apparatus 80 into the cartridge 50. The air inlet hole 50*a* is located in an opposite side of the cigarette insertion passage 42, facing the cover 70 when the cartridge 50 is coupled to the cartridge mounting portion 49.

The cigarette support portion 41 may include a delivery passage 41*p* for delivering the aerosol delivered through the outlet 50*e* of the cartridge 50 to the cigarette insertion passage 42 into which the cigarette 2 is inserted.

The air passage 50*s* extends long along a direction parallel to the direction in which the cigarette 2 extends, and the extension direction of the air passage 50*s* may be parallel to the direction in which the cigarette 2 extends.

The air flowing into the inside of the cover 70 from the outside of the aerosol generating apparatus 80 is mixed with the primary aerosol generated in the cartridge 50, and the mixed air flows into the cigarette insertion passage 42 through the delivery passage 41*p* connected to the outlet 50*e* of the cartridge 50.

When the cigarette 2 is mounted on the aerosol generating apparatus and electricity is applied to the cartridge 50, the liquid composition is vaporized, thereby primarily generating the aerosol. In the first aerosol generation process, various flavor components included in the liquid material 51 of the cartridge 50 are converted into aerosol.

When the user bites the cigarette 2 and inhales, suction pressure is formed in the chamber 50*p* of the cartridge 50. As such, the primary aerosol generated from the liquid material 51 of the cartridge 50 may be delivered to the user through the cigarette 2 after flowing into the aerosol delivery passage 41*p*.

While the primary aerosol passes through the cigarette 2, the secondary aerosol may be generated as the primary aerosol contacts the aerosol generating material contained in the cigarette 2. For example, the cigarette 2 may contain a nicotine component, and while the primary aerosol passes through the cigarette, the nicotine component contained in the cigarette 2 is mixed with the primary aerosol. In order for the mixing to occur, the cigarette 2 only needs to be heated to a temperature range sufficient to deliver the nicotine component to the air passing through the cigarette.

The cover 70 including a ventilation hole 70*a* for introducing external air into the inside is coupled to the main body 40. The cover 70 may be detachably coupled to the upper portion of the main body 40. The cover 70 includes a ventilation hole 70*a* and a cigarette hole 71 through which the cigarette 2 coupled to the main body 40 passes. Also, the cover 70 is coupled to the main body 40 to cover the cartridge 50 and the cigarette support 41 coupled to the main body 40. A hole cover 78 may be movably installed on the upper surface of the cover 70. The hole cover 78 may open and close the cigarette insertion passage 42.

The cover 70 includes an upper plate 75 which includes the cigarette hole 71. The upper plate 75 faces the cartridge 50 coupled to the main body 40 and an upper surface of the cigarette support portion 41. Also, the cover 70 includes a side plate 76 which extends from the upper plate 75 toward the main body 40 to cover the side of the cigarette support portion 41 and the side of the cartridge 50. The ventilation hole 70*a* is formed at a position adjacent to the air inlet hole 50*a* of the cartridge 50 in the side plate 76.

Since the ventilation hole 70*a* is formed at the position adjacent to the air inlet hole 50*a* of the cartridge 50, the ventilation hole 70*a* may discharge the aerosol, which is generated in the cartridge 50 and remains inside the cartridge 50 and the cover 70, to the outside of the aerosol generating apparatus 80. Also, the ventilation hole 70*a* may introduce outside air into the aerosol generating apparatus 80.

Most of the aerosol generated in the chamber 50*p* of the cartridge 50 is inhaled toward the cigarette 2, but after the user finishes puffing the cigarette 2, the generated aerosol may remain in the chamber 50*p*. The remaining aerosol is vaporized from the liquid, so is in a heated state, but may be liquefied again by contact with air in the air passage 50*s*. As a result, the aerosol may be changed into droplets (dropletization). However, in the aerosol generating apparatus 80 and the aerosol generating system 90 according to the above-described embodiment, since the remaining aerosol may be easily discharged to the outside through the ventilation hole 70*a* of the cover 70, it is possible to minimize the phenomenon that droplets (liquid drops) are formed inside the cover 70 and inside the aerosol generating apparatus 80.

The cigarette hole 71 of the cover 70 may be formed larger than the diameter of the cigarette 2 such that at least a portion of the inner surface of the cigarette hole 71 is disposed away from the cigarette 2. As such, the air outside the aerosol generating apparatus 80 may flow into the inside of cover 71 through the cigarette hole 71.

When the cigarette 2 is inserted in the cigarette support portion 41, the direction L in which the cigarette 2 extends crosses the straight line H passing through the chamber 50*p* and the outlet 50*e* of the cartridge 50 and the delivery passage 41*p* of the cigarette support portion 41. The direction L in which the cigarette 2 extends in the state in which the cigarette 2 is inserted in the cigarette support portion 41 may be a direction perpendicular to the straight line H passing through the chamber 50*p*, the outlet 50*e* of the cartridge 50, and the delivery passage 41*p* of the cigarette support portion 41.

In the aerosol generating apparatus and system according to the above-described embodiment, a sufficient amount of air for aerosol generation may be secured by introducing air entering into the inside of the cover 70 through the cigarette hole 71 and the ventilation hole 70*a* into the cartridge 50. In addition, since the path of the air flow from the chamber 50*p* of the cartridge 50 to the delivery passage 41*p* of the cigarette support portion 41 forms a straight line H, resistance to air flow may be minimized, and due to this, a stable flow of air for optimal aerosol generation may be formed.

In the aerosol generating apparatus and system according to the above-described embodiment, primary aerosol containing various flavor components are primarily generated by the primary aerosol generating action. And then, while the primary aerosol pass through the cigarette, a secondary aerosol containing the nicotine component are generated. Thereby, the aerosol containing the rich flavor and sufficient nicotine component may be delivered to the user.

The aerosol generating apparatus and system according to the above described embodiment have several advantages compared to a conventional apparatus which generates aerosol by placing both the flavor component and the nicotine component in the cigarette and heating the cigarette.

When all the components for aerosol generation are placed in the cigarette, the cigarette must be heated to a high temperature to vaporize the various components. However, in the aerosol generating apparatus and system according to the above described embodiment, since only the nicotine component is disposed in the cigarette or some auxiliary flavor components and nicotine components are disposed in the cigarette, the heating temperature of the cigarette may be set relatively low.

The primary aerosol may be generated by heating a liquid material in a cartridge including a liquid aerosol generating source, and the secondary aerosol that is finally delivered to the user may be generated as the primary aerosol passes through the cigarette. In this regard, by combining the cartridge and the cigarette in various ways, it is possible to generate aerosol having various flavors that may satisfy various needs of users.

In addition, after the user finishes inhaling, the aerosol generated by the cartridge is easily discharged to the outside through the ventilation hole of the cover. Therefore, by minimizing the droplets (liquid drops) formed inside the aerosol generating apparatus, it is possible to protect electronic components of the aerosol generating apparatus from contamination by droplets.

Figure 8:
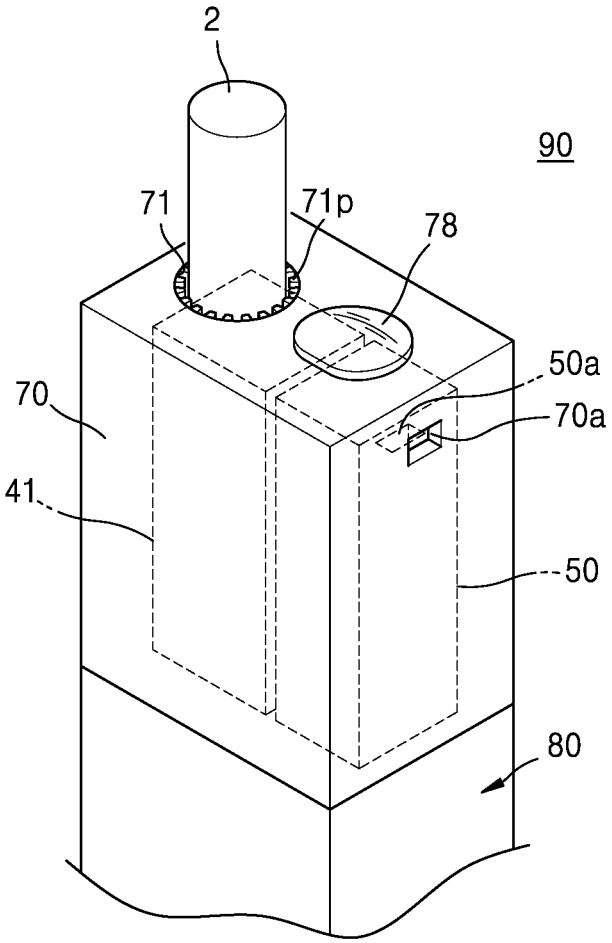
FIG. 8 is a perspective view schematically showing a portion of an aerosol generating system according to still another embodiment.

FIG. 8 is a perspective view schematically showing a portion of an aerosol generating system according to still another embodiment.

The overall configuration of the aerosol generating system 90 and an aerosol generating apparatus 80 according to the embodiment shown in FIG. 8 is similar to the configuration of the aerosol generating system and apparatus according to the embodiments shown in FIGS. 6 and 7.

The aerosol generating system 90 shown in FIG. 8 includes a main body 40 that includes a cigarette support portion 41 for detachably supporting a cigarette 2 and detachably supports a cartridge 50, the cartridge 50 including an air inlet hole 50*a* through which air is introduced from the outside and detachably coupled to the main body 40, the cigarette 2 detachably coupled to the main body 40, and a cover 70 that includes a cigarette hole 71 and a ventilation hole 70*a* formed at a position adjacent to the air inlet hole 50*a* of the cartridge 50. The cigarette 2 may be coupled to the main body 40 through the cigarette hole 71. The cover 70 may be detachably coupled to the main body 40 so as to cover the cartridge 50 coupled to the main body 40.

Since the protrusions 71*p* are formed on the inner circumferential surface of the cigarette hole 71 of the cover 70, the external air may be introduced into the inside of the cover 70 through spaces formed between the protrusions 71*p* and the outer surface of the cigarette 2.

The protrusions 71*p* disposed on the inner circumferential surface of the cigarette hole 71 of the cover 70 perform a function of passing air. Also, by supporting the outer surface of the cigarette 2, the protrusions 71*p* may stably maintain the state in which the cigarette 2 is inserted into the main body 40.

In FIG. 8, the air inlet hole 50*a* of the cartridge 50 is formed on the side of the cartridge 50. However, the location where the air inlet hole 50*a* is installed is not limited thereto, and the installation position of the air inlet hole 50*a* illustrated in FIG. 8 may be changed. For example, the air inlet hole 50*a* may be disposed on the upper surface of the cartridge 50 or may be disposed at a position adjacent to the lower end of the cartridge 50.

Figure 9:
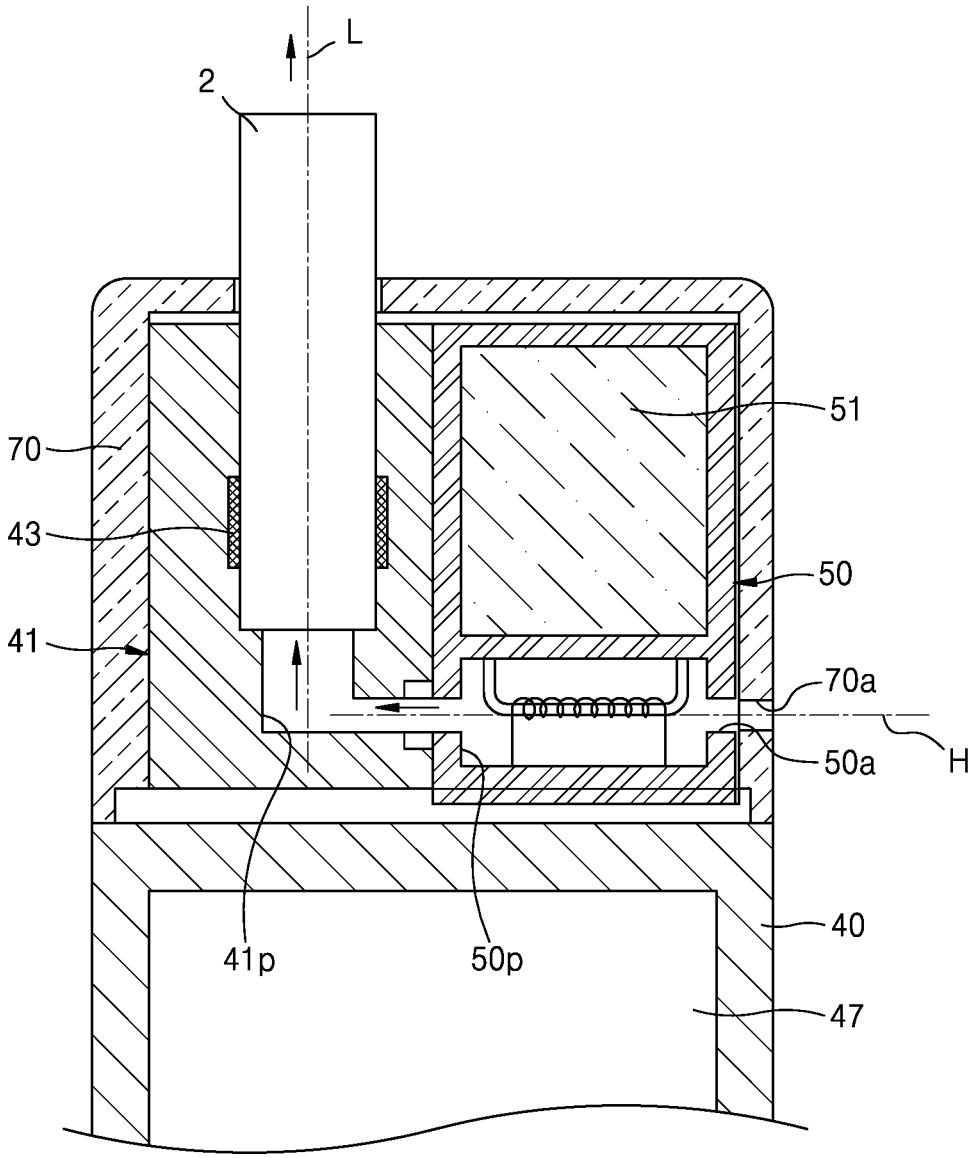
FIG. 9 is a cross-sectional view schematically showing a portion of an aerosol generating system according to still another embodiment.

FIG. 9 is a cross-sectional view schematically showing a portion of an aerosol generating system according to still another embodiment.

The aerosol generating system and apparatus according to the embodiment shown in FIG. 9 is similar to the configuration of the aerosol generating system and apparatus according to the embodiments shown in FIGS. 6 to 8.

The aerosol generating system shown in FIG. 9 includes a main body 40 that includes a cigarette support portion 41 for detachably supporting a cigarette 2 and a cartridge mounting portion 49 for detachably supporting a cartridge 50, the cartridge 50 including an air inlet hole 50*a* through which air is introduced from the outside and detachably coupled to the main body 40, the cigarette 2 detachably coupled to the main body 40, and a cover 70 including a cigarette hole 71 and a ventilation hole 70*a* formed at a position adjacent to the air inlet hole 50*a* of the cartridge 50. The cigarette 2 may be coupled to the main body 40 through the cigarette hole 71. The cover 70 may be detachably coupled to the main body 40 so as to cover the cartridge 50 coupled to the main body 40.

The cartridge 50 may accommodate the liquid material 51 therein, and when electricity is applied to the cartridge 50, the cartridge 50 heats the liquid material 51 to vaporize, thereby generating aerosol.

The cartridge 50 includes a chamber 50*p* that defines a space where the liquid material 51 is heated to generate aerosol, an outlet for discharging the aerosol in the chamber 50*p* toward the cigarette 2, and an air inlet hole 50*a*. The air inlet hole 50*a* is directly connected to the chamber 50*p*, thereby exposing the chamber 50*p* to the outside of the cartridge 50. The air inlet hole 50*a* of the cartridge 50 introduces air outside the aerosol generating apparatus 80 into the cartridge 50.

The cover 70 is coupled to the main body 40 so as to cover the cartridge 50 and the cigarette support 41 coupled to the main body 40. The cover 70 may include a ventilation hole 70*a* that introduces external air into the inside. The ventilation hole 70*a* may be formed at a lower portion of the side plate of the cover 70 so as to be adjacent to the air inlet hole 50*a* of the cartridge 50.

Since the ventilation hole 70*a* is formed at the position adjacent to the air inlet hole 50*a* of the cartridge 50, the ventilation hole 70*a* may discharge the aerosol, which is generated in the cartridge 50 and remains inside the cartridge 50 and the cover 70, to the outside of the aerosol generating apparatus 80. Also, the ventilation hole 70*a* may introduce outside air into the aerosol generating apparatus 80.

When the cigarette 2 is inserted in the cigarette support portion 41, the direction L in which the cigarette 2 extends crosses the straight line (H) passing through the chamber 50*p*, the outlet 50*e* of the cartridge 50, and the delivery passage 41*p* of the cigarette support portion 41. The direction L may be perpendicular to the straight line H passing through the air inlet hole 50*a*, the chamber 50*p*, the outlet 50*e* of the cartridge 50, and the delivery passage 41*p* of the cigarette support portion 41.

In the aerosol generating apparatus and system according to the above-described embodiment, a sufficient amount of air for aerosol generation may be secured by introducing air entering into the inside of the cover 70 through the cigarette hole 71 and the ventilation hole 70*a* into the cartridge 50. In addition, since the path of the air flow from the chamber 50*p* of the cartridge 50 to the delivery passage 41*p* of the cigarette support portion 41 forms a straight line H, resistance to air flow may be minimized. As a result, a stable flow of air for optimal aerosol generation may be formed.

Those of ordinary skill in the art related to the present embodiments may understand that various changes in form and details can be made therein without departing from the scope of the characteristics described above. The disclosed methods should be considered in a descriptive sense only and not for purposes of limitation.

INDUSTRIAL APPLICABILITY

Embodiments relate to an aerosol generating apparatus and an aerosol generating system capable of generating aerosol having a rich flavor by passing aerosol generated in a cartridge through a cigarette.

What is claimed is:

1. An aerosol generating system comprising:

a main body;

a cartridge detachably coupled to the main body, comprising an air inlet hole through which external air is introduced, and configured to store a liquid material and generate aerosol by heating the liquid material;

a cigarette detachably coupled to the main body, comprising a solid material, and disposed on a path along which the aerosol generated in the cartridge flows such that the aerosol passes through the solid material and is discharged to outside; and a cover detachably coupled to the main body to cover the cartridge coupled to the main body and comprising:

a cigarette hole through which the cigarette is coupled to the main body; and a ventilation hole formed at a position adjacent to the air inlet hole of the cartridge and configured to discharge the aerosol remaining in the cartridge to the outside or introduce the external air, wherein the cigarette has a rod shape extending long in a longitudinal direction, wherein the aerosol passes through the cigarette along the longitudinal direction to be discharged to the outside, wherein the cartridge and the cigarette are arranged in parallel with respect to the longitudinal direction of the cigarette, wherein the main body includes:

a cigarette support portion comprising a cigarette insertion passage into which at least a portion of the cigarette is inserted, supporting the cigarette inserted in the cigarette insertion passage, and configured to transfer heat to the cigarette; and a cartridge mounting portion formed next to the cigarette support portion and detachably supporting the cartridge, and wherein the air inlet hole of the cartridge is located opposite the cigarette insertion passage on a face of the cartridge, the face facing the cover when the cartridge is coupled to the cartridge mounting portion.

2. The aerosol generating system of claim 1, wherein the cover further includes:

an upper plate which includes the cigarette hole and faces the face of the cartridge and an upper surface of the cigarette support portion; and a side plate which extends from the upper plate toward the main body to cover a side of the cigarette support portion and a side of the cartridge, and the ventilation hole is formed at a position adjacent to the air inlet hole of the cartridge in the side plate.

3. The aerosol generating system of claim 1, wherein the cartridge further includes:

a liquid heater configured to heat the liquid material;

a chamber which surrounds the liquid heater to define a space in which the aerosol is generated;

an outlet which connects the chamber and the cigarette such that the aerosol is discharged toward the cigarette; and an air passage which connects the chamber and the air inlet hole.

4. The aerosol generating system of claim 3, wherein the air passage extends in the longitudinal direction of the cigarette, and the cigarette and the air passage are arranged in parallel with respect to the longitudinal direction of the cigarette.

5. An aerosol generating system comprising:

a main body;

a cartridge detachably coupled to the main body, comprising an air inlet hole through which external air is introduced, and configured to store a liquid material and generate aerosol by heating the liquid material;

a cigarette detachably coupled to the main body, comprising a solid material, and disposed on a path along which the aerosol generated in the cartridge flows such that the aerosol passes through the solid material and is discharged to outside; and a cover detachably coupled to the main body to cover the cartridge coupled to the main body and comprising:

a cigarette hole through which the cigarette is coupled to the main body; and a ventilation hole formed at a position adjacent to the air inlet hole of the cartridge and configured to discharge the aerosol remaining in the cartridge to the outside or introduce the external air, wherein the cigarette hole of the cover is formed such that at least a portion of an inner surface of the cigarette hole facing the cigarette is separated from the cigarette to introduce the external air to inside of the cover.

6. An aerosol generating apparatus comprising:

a main body;

a cartridge mounting portion installed in one area of the main body to detachably support a cartridge, wherein the cartridge stores a liquid material, generates aerosol by heating the liquid material, and includes an air inlet hole through which external air is introduced;

a cigarette support portion installed in another area of the main body to detachably support a cigarette including a solid material, and configured to transfer the aerosol generated in the cartridge to the cigarette and heat the cigarette;

an electricity supply portion disposed on the main body and configured to supply electricity to the cartridge and the cigarette support portion coupled to the main body; and a cover detachably coupled to the main body to cover the cartridge coupled to the main body, comprising a cigarette hole through which the cigarette is coupled to the main body and a ventilation hole formed at a position adjacent to the air inlet hole of the cartridge, and configured to discharge the aerosol remaining in the cartridge to outside or introduce the external air, wherein the cigarette support portion includes a cigarette insertion passage through which at least a portion of the cigarette is inserted, wherein the air inlet hole of the cartridge is located opposite the cigarette insertion passage on a face of the cartridge, the face facing the cover when the cartridge is coupled to the cartridge mounting portion, wherein the cover further includes:

an upper plate which includes the cigarette hole and faces the face of the cartridge and an upper surface of the cigarette support portion; and a side plate which extends from the upper plate toward the main body to cover a side of the cigarette support portion and a side of the cartridge, and wherein the ventilation hole is formed at a position adjacent to the air inlet hole of the cartridge in the side plate.

7. The aerosol generating apparatus of claim 6, wherein the cigarette hole in the cover is formed such that at least a portion of an inner surface of the cigarette hole facing the cigarette is separated from the cigarette to introduce the external air to inside of the cover.

* * * * *